US006910462B2

(12) United States Patent
Sun et al.

(10) Patent No.: US 6,910,462 B2
(45) Date of Patent: Jun. 28, 2005

(54) DIRECTLY CONTROLLED FUEL INJECTOR WITH PILOT PLUS MAIN INJECTION SEQUENCE CAPABILITY

(75) Inventors: Jinhui Sun, Bloomington, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/919,200

(22) Filed: Aug. 16, 2004

(65) Prior Publication Data

US 2005/0028783 A1 Feb. 10, 2005

Related U.S. Application Data

(63) Continuation-in-part of application No. 10/637,452, filed on Aug. 8, 2003.

(51) Int. Cl.[7] ..... F02M 1/00
(52) U.S. Cl. ..... 123/445; 123/457
(58) Field of Search ..... 123/445, 446, 123/457

(56) References Cited

U.S. PATENT DOCUMENTS 4,098,560 A * 7/1978 O'Neill ..... 417/214
5,738,075 A 4/1998 Chen et al.
6,065,450 A 5/2000 Chen et al.
6,082,332 A 7/2000 Hefler et al.
6,298,826 B1 * 10/2001 Cotton, III ..... 123/446
6,390,070 B2 5/2002 Coldren et al.
6,595,188 B2 * 7/2003 Forck et al. ..... 123/446
2003/0101967 A1 * 6/2003 Forck et al. ..... 123/446
2004/0103878 A1 * 6/2004 Satapathy et al. ..... 123/321
2004/0255908 A1 * 12/2004 Udd et al. ..... 123/446

* cited by examiner

*Primary Examiner*—John T. Kwon
(74) *Attorney, Agent, or Firm*—Liell & McNeil

(57) ABSTRACT

In one class of fuel injection systems, the individual fuel injectors cycle between high and low pressure during and between injection sequences in a given engine cycle. The fuel injectors may be hydraulically actuated, mechanically actuated, and possibly include common rail injectors equipped with an admission valve that enable the fuel injectors to cycle between high and low pressures. Many of these fuel injection systems also include a directly controlled nozzle valve that can apply or relieve pressure on a closing hydraulic surface associated with the nozzle valve. The nozzle valve is typically spring-biased and therefore has a pre-defined valve opening pressure that defines at what fuel pressure the nozzle valve will open when pressure is relieved on its closing hydraulic surface. While these fuel injection systems can produce a wide variety of rate shapes and injection sequences, generally, an injection sequence of particular interest is one that includes a relatively small volume pilot injection followed quickly in time by a relatively large volume main injection. In order to make the accuracy of the pilot injection more consistent, the nozzle valve is held closed while fuel pressure in the fuel injector builds and surpasses the valve opening pressure of the nozzle valve. This strategy helps to alleviate sensitivity of the pilot injection volume to inherent variability factors, such as geometrical tolerances, within and between fuel injectors.

15 Claims, 2 Drawing Sheets

DIRECTLY CONTROLLED FUEL INJECTOR WITH PILOT PLUS MAIN INJECTION SEQUENCE CAPABILITY

RELATION TO OTHER PATENT APPLICATION

This application is a continuation in part of co-pending patent application Ser. No. 10/637,452, filed Aug. 8, 2003, entitled Hydraulic Fuel Injection System With Independently Operable Direct Control Needle Valve.

TECHNICAL FIELD

The present disclosure relates generally to pilot plus main fuel injection sequences, and more particularly to a strategy for improving accuracy in a pilot injection for fuel injectors that cycle between high and low pressure during each engine cycle.

BACKGROUND

Over the years, engineers have come to recognize that some undesirable emissions can be substantially reduced using particular injection sequences and/or rate shapes at particular engine operating conditions. For instance, engineers have come to recognize that at some engine operating conditions, it is desirable to deliver fuel to the engine cylinder in a so called pilot plus main injection sequence. By injecting a relatively small pilot amount of fuel and then following the same with the main injection event containing the bulk of the fuel for that cylinder, it has been found that the resulting combustion is improved relative to a similar injection quantity injected all at once. In other words, at least one of NOx, unburned hydrocarbons and particulates are reduced when utilizing a pilot plus main injection sequence at certain engine operating conditions.

While it may be known that pilot plus main injection sequences are desirable at certain engine operating conditions, it has proven problematic to consistently and accurately control the relatively small pilot injection. Not only do realistic geometrical tolerances and other factors cause a plurality of otherwise identical fuel injectors to behave somewhat differently when supplied with identical control signals, a given injector may also not produce consistent injection results based upon receiving identical control signals over a plurality of engine cycles. If the injector's behavior deviates too substantially from an expected injection sequence, the goal of lower undesirable emissions from the engine may not be consistently achieved.

The present disclosure is directed to one or more of the problems set forth above.

SUMMARY OF THE DISCLOSURE

In one aspect, a method of injecting fuel includes a step of raising fuel pressure in a fuel injector at least in part with a pressure control valve. A nozzle valve is opened for a pilot injection after fuel pressure is above a valve opening pressure for the nozzle valve. This is accomplished at least in part by actuating a needle control valve in a first direction. The nozzle valve is then closed while fuel pressure is maintained above the valve opening pressure, at least in part by actuating the needle control valve in a second direction. Next, the nozzle valve is reopened for a main injection while fuel pressure is maintained above the valve opening pressure, at least in part by actuating the needle control valve back in its first direction. Finally, fuel pressure in the fuel injector is reduced.

In another aspect, a method of improving accuracy of a pilot injection in a pilot plus main injection sequence includes a step of holding the nozzle valve closed while fuel pressure surpasses a valve opening pressure for the nozzle valve. The nozzle valve is then opened at least in part by either energizing or deenergizing an electrical actuator. The nozzle valve is enclosed to end the pilot injection event at least in part by the other of energizing and de-energizing the electrical actuator.

DETAILED DESCRIPTION

Figure 3:
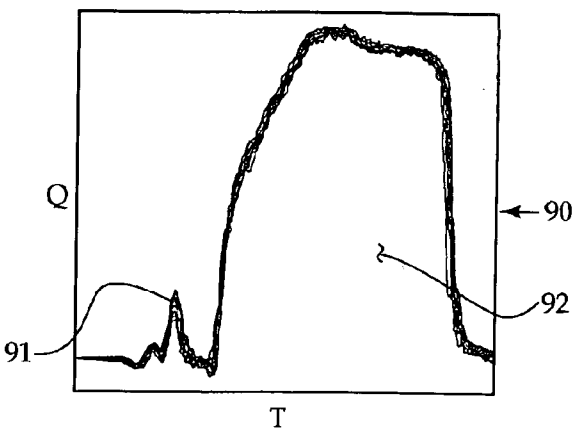
FIG. 3 is a graph of fuel injection rate verses time for a pilot plus main injection sequence according to another aspect of the present disclosure.
Figure 2:
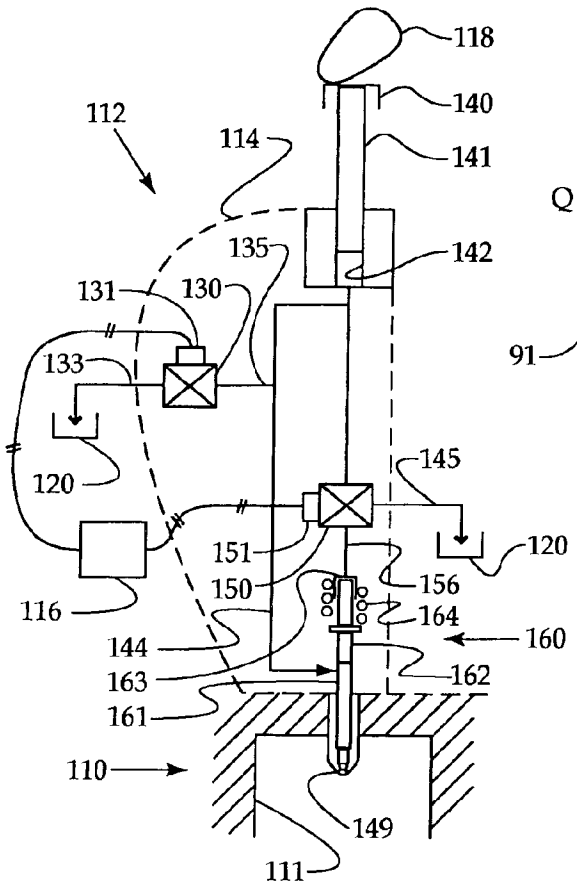
FIG. 2 is a schematic illustration of a mechanically actuated fuel injector according to another aspect of the disclosure.
Figure 1:
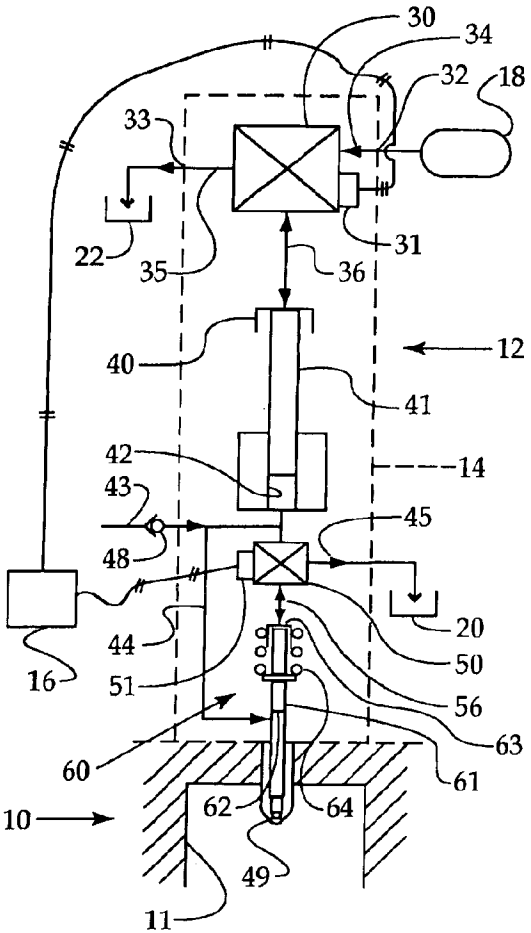
FIG. 1 is a schematic illustration of a hydraulically actuated fuel injector according to one aspect of the disclosure.

Referring to FIGS. 1 and 2, example fuel injection systems 12 and 112 are illustrated in a schematic form. Fuel injection system 12 is a hydraulically actuated pressure intensified fuel injector that includes a direct control needle valve 60. Fuel injection system 112 is a mechanically actuated fuel injector that also includes a direct control needle valve 160. Both fuel injection systems include a separate pressure control valve. Thus, during each engine cycle, each fuel injector will cycle between high and low pressure states during and between injection sequences, respectively. Thus, the present disclosure is applicable to any fuel injection system that cycles between high and low pressure, and includes an electrical actuator associated with a direct control needle valve. Apart from the fuel injection systems illustrated, the present disclosure might also find potential application to common rail fuel injectors that are equipped with both an admission valve (pressure control valve) and a separate direct control needle valve. Although these different fuel injection systems operate differently, they are all designed to have the capability of producing a wide variety of different injection sequences and injection rate shapes in order to have the flexibility to produce injection profiles at different engine operating conditions to reduce undesirable emissions, which include NOx, unburned hydrocarbons and particulates. Although there are a wide variety of injection sequences and rate shapes, the present disclosure is primarily concerned with injection sequences that include a so called pilot plus main injection, in which a relatively small volume pilot injection is followed after a brief dwell period with a relatively large volume main injection, as shown in FIG. 3.

Referring specifically to FIG. 1, fuel injection system 12 includes a fuel injector 14 mounted in an engine 10 for a direct injection into a cylinder 11. Although only one injector 14 is shown. Those skilled in the art will appreciate that a separate injector would be associated with each engine cylinder. Fuel injector 14 includes an oil inlet 32 connected to a source of high pressure oil 18, which can be common to a plurality of fuel injectors. After performing work in injector 14, the oil is returned for recirculation to a low pressure reservoir 22 via an oil drain outlet 33. The flow of oil into and out of fuel injector 14 is controlled by a pressure control valve 30 that is operably coupled to an electrical actuator 31, which can be a solenoid, a piezo electric bender, a piezo stack or any other suitable electrical actuator. When electrical actuator 31 is de-energized, intensifier passage 36 is fluidly connected to drain passage 35 such that intensifier piston 40 will retract toward its upper position to expel used oil from the fuel injector 14 via a return spring (not shown). When electrical actuator 31 is energized, high pressure passage 34 is connected to intensifier passage 36 to allow high pressure oil to act on the top of intensifier piston 40 to drive it and plunger 41 downward to pressurize fuel in fuel pressurization chamber 42 for an injection sequence. Between injection events, when plunger 41 and intensifier piston 40 are retracting, low pressure fuel is drawn from a source 20 via a low pressure fuel inlet 43 into fuel pressurization chamber 42. Reverse flow of fuel out of inlet 43 is prevented by a check valve 48 in a conventional manner.

Fuel injector 14 includes a direct control needle valve 60 that controls the opening and closing of nozzle outlet set 49. In particular, direct control needle valve 60 includes a needle portion 61 that is biased downward toward a closed position by a biasing spring 64 in a conventional manner. Direct control needle valve 60 also includes a closing hydraulic surface 63 exposed to fluid pressure in a pressure communication passage 56. A needle control valve 50 is operable to fluidly connect pressure control passage 56 either to a low pressure return line 45 or to fuel pressurization chamber 42 in a conventional manner. An electrical actuator 51, which can be a solenoid, a piezo or any other suitable electrical actuator, is operably coupled to move needle control valve between these two positions. However, needle control valve 50 is preferably normally biased, such as via a spring, to a position that fluidly connects pressure control passage 56 to low pressure drain line 45 when electrical actuator 51 is de-energized.

When pressure communication passage 56 is connected to low pressure return line 45, and fuel pressure in nozzle supply passage 44 acting on lifting hydraulic surface 62 of needle portion 61 is above a valve opening pressure, needle portion 61 will lift against the action of spring 64 to open nozzle outlet set 49. When electrical actuator 51 is energized and pressure communication passage 56 is connected to fuel pressurization chamber 42, fluid pressure acting on closing hydraulic surface 63 will cause direct control needle nozzle valve 60 to either stay in or move toward its downward closed position to close nozzle outlets 49. Thus, needle control valve 50 allows for the nozzle outlets 49 to be opened at or above the valve opening pressure for the direct control needle valve 60, which is defined by the relationship between the fuel pressures, the effective area of lifting hydraulic surface 62 and the pre-load of biasing spring 64 in a manner well known in the art. Electrical actuators 31 and 51 are independently controlled via an electronic control module 16 in a conventional manner.

Referring now to FIG. 2, a cam actuated fuel injection system 112 includes an individual fuel injector 114 positioned in each engine cylinder 111 of engine 110. When cam 118 rotates, it causes a tappet 140 and a plunger 141 to move downward to pressurize fuel in a fuel pressurization chamber 142. If a spill valve (pressure control valve) 130 is open, the fuel is merely displaced at a low pressure via spill passage 135 and drain outlet 133 to a low pressure reservoir 120. However, if electrical actuator 131 is energized to close spill valve 130, fuel pressure can build within fuel injector 114 to injection pressures. Pressurized fuel from fuel pressurization chamber 142 is supplied to the nozzle via a nozzle supply 144, and is sprayed into engine cylinder 111 when nozzle outlets 149 are open. The opening and closing of nozzle outlet set 149 is controlled by a direct control needle valve 160 via a needle control valve 150, which is operably coupled to an electrical actuator 151. When in its first position, needle control valve 150 fluidly connects a pressure control passage 156 to low pressure reservoir 120 via return line 145. When in this position, a fuel pressure acting on opening hydraulic surface 162 that is above a valve opening pressure, needle valve member 161 will lift upward toward its open position to allow fuel to spray out of nozzle outlet set 149. As is well known in the art, the valve opening pressure for direct control needle valve 160 is a function of the effective area of lifting hydraulic surface 162, the spring pre-load of spring 164 and the fluid pressures in the system. Direct control needle valve 160 also includes a closing hydraulic surface 163 that is exposed to fluid pressure in pressure communication passage 156. However, when needle control valve 150 connects pressure control passage 156 to low pressure return line 145, the needle portion 161 will lift against the action of spring 164 when fuel pressure acting on opening hydraulic surface 162 is above a valve opening pressure (VOP). When needle control valve 150 is moved to its second position, pressure control passage 156 becomes fluidly connected to fuel pressurization chamber 142. The effective area of closing hydraulic surface 163 is such that needle portion 161 will stay in, or move toward, its downward closed position when needle control valve 150 fluidly connects pressure control passage 156 to fuel pressurization chamber 142. The movement of needle control valve 150 is controlled by an electrical actuator 151. Those skilled in the art will appreciate that needle control valve 150 can be arranged such that electrical actuator 151 needs to be de-energized to allow injection to occur, or be arranged such that electrical actuator 151 needs to be energized in order for an injection event to occur. Either arrangement is compatible with the present disclosure. As in the previous fuel injection system, the electrical actuators 131 and 151 are independently controlled and energized in a conventional manner by an electronic control module 116.

INDUSTRIAL APPLICABILITY

The present disclosure find potential application to any fuel injector that cycles between high and low pressure via a pressure control valve during an engine cycle. Although the illustrated examples show an electronically controlled pressure control valve, the present disclosure might also find application to pressure control valves that are mechanically actuated. The present disclosure also applies to such pressure controlled fuel injectors that include a direct control needle valve that allows the nozzle valve to be held closed even when fuel pressure within the fuel injector is above the valve opening pressure of the nozzle valve. Thus, the present disclosure might find potential application to mechanically actuate a pressure control valves, such as a fuel injection system that utilizes a flow distributor to sequentially connect different fuel pressures to a source of high pressure oil rather than one that utilizes an electronically controlled pressure control valve for each individual fuel injector. In addition, the present disclosure might find potential application to a common rail fuel injection system wherein each fuel injector is cycled through high and low pressure via an admission valve that is opened and closed for each injection cycle. The admission valve would preferably be operated via a separate electronic actuator.

Although the illustrated examples show a needle control valve that is a three-way valve that either connects the pressure communication passage to low pressure to high pressure, other needle control valves could be compatible with the present disclosure. For instance, a needle control valve that opens and closes the pressure communication passage to drain in order to allow injection would also be compatible. In this alternative, the pressure control passage is always fluidly connected to the fuel pressurization chamber, but by locating flow restrictions at selected locations that are known in the art, the single two-way needle control valve on the drain side can effectively control the pressure in the volume acting on the closing hydraulic surface of the direct control nozzle valve. Thus, the disclosure is not limited to three way needle control valves, but also encompasses any strategy and structure for direct control needle valves that effectively apply and relieve pressure on a closing hydraulic surface of the nozzle valve. The present disclosure is not so much interested in how the fuel is pressurized for an injection sequence, but rather that it is pressurized and de-pressurized during each engine cycle. Although fuel injection systems according to the present disclosure can normally produce a relatively wide variety of flow rate shapes and injection sequences, the present disclosure is primarily concerned with injection sequences that include a relatively small pilot injection followed quickly by a relatively large main injection. Such an injection sequence has proven to have the ability to reduce undesirable admissions at certain engine operating conditions. Such an injection sequence is shown for example in FIG. 3 where multiple successive injection sequences 90 are graphed to show the repeatability of the small pilot injection 91 with the relatively large main injection 92. The problem addressed in the present disclosure is not so much how to create a pilot plus main injection sequence, but rather how to produce such a sequence wherein the pilot injection volume is repeatable, consistent and accurately controlled.

Figure 4:
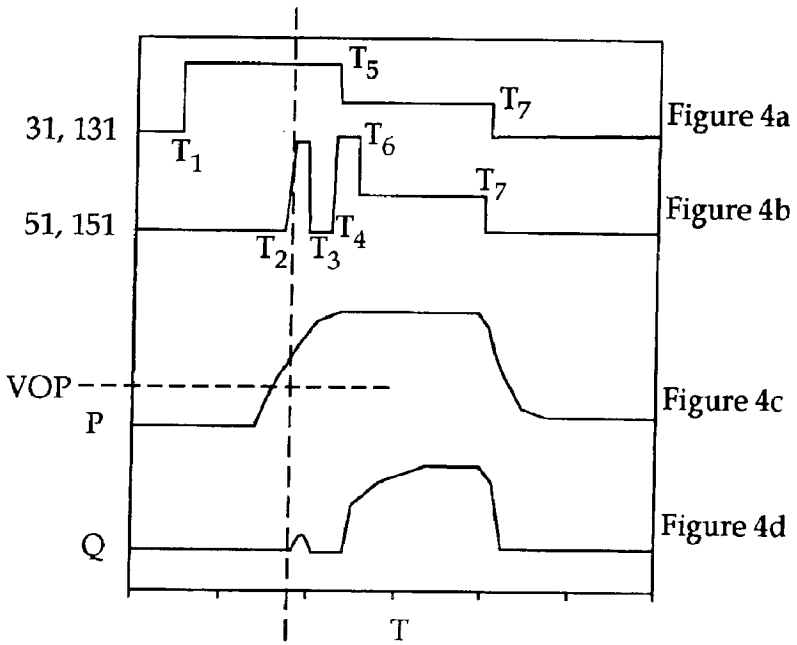
FIGS. 4*a–d* are graphs of pressure control valve actuator signal, needle control valve actuator signal, sleeve pressure and injection flow rate verses time for an example pilot plus main injection sequence.

Referring now to FIGS. 4*a–d*, an example pilot plus main injection sequence for each of the fuel injection systems 12 and 112 is illustrated. Between injection events, fuel pressure within the individual injectors is relatively low. At some time T1, as the timing of a desired injection event approaches, the pressure control actuator 31, 131 is energized to a pull-in current to allow fuel pressure to begin to build in the individual fuel injectors. In the case of fuel injector 14, this allows high pressure oil to begin acting on intensifier piston 40 to begin moving plunger 41 downward to pressurize fuel in fuel pressurization chamber 42. In the case of fuel injector 114, the energizing electrical actuator 131 closes spill pressure control valve 130 to allow fuel pressure in fuel pressurization chamber 142 and nozzle supply passage 144 to build in injection levels. FIG. 4*c* shows the fuel pressure in the individual fuel injectors growing after some brief delay from the timing T1. At a timing T2, the needle control valve actuator 51, 151 is briefly energized to initiate the pilot injection event 91. The needle control valve actuator 51, 151 is then de-energized a short time later at time T3. The duration between time T2 and T3 is determined to produce a relatively small pilot injection quantity 91. However, it is important to note that the pilot injection 91 occurs when fuel pressure is relatively high and well above the valve opening pressure (VOP) of the direct control needle valve 60, 160. By initiating the pilot injection event when fuel pressure is relatively high, the pilot injection event is desensitized from small variabilities that inevitably exist between different fuel injectors as to their specific valve opening pressure, when that fuel injector would achieve that valve opening pressure after operating its respective pressure control valve, and different issues, such as friction, regarding the rate at which the nozzle valve opens when fuel pressure exceeds the valve opening pressure. Instead, the present disclosure seeks to initiate the pilot injection event when fuel pressure is somewhat or substantially above the valve opening pressure but far before reaching the full pressure so that, not only does the individual fuel injector behave consistent with itself, but behaves in a manner more consistent with other identical fuel injectors, that may be located in the same engine.

A short time after T3, the needle control valve actuator 51, 151 is again re-energized at time T4 to initiate the main injection event 92. At a time T5, the pressure control actuator 31, 131 is dropped to a hold in current, that maintains the valve in its position without an unnecessary expenditure of energy. Likewise, at time T6, the needle control valve actuator 51, 151 is dropped to a hold in current level for the remaining duration of the main injection event 92. At time T7, the electrical actuators are de-energized to end the main injection event.

The conventional wisdom has long held that accurate injection of relatively small amounts of fuel should be done at lower pressures in order to expand the duration over which the small injection takes place. The present disclosure, however, defies the conventional wisdom by seeking to inject small pilot injections at higher pressures for briefer periods of time. Thus, the conventional wisdom would suggest that the electrical actuators of the individual fuel injector should be energized at relative timings such that the pilot injection event occurs while pressure is increasing such that the nozzle valve merely opens when the fuel pressure overcomes the valve opening pressure of the nozzle valve. While such a strategy at first glance appears sound, achieving consistent results has proven problematic due to a variety of known and possibly unknown factors. The present disclosure desensitizes the injector performance to many of these factors by holding the nozzle valve closed until the fuel pressure is substantially above the valve opening pressure of the nozzle valve by utilizing the needle control valve to maintain high pressure on the closing hydraulic surface of the nozzle valve while fuel pressure is increasing within the fuel injector.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A method of injecting fuel, comprising the steps of:

raising fuel pressure in a fuel injector at least in part with a pressure control valve;

opening the nozzle valve for a pilot injection after fuel pressure is above a valve opening pressure for the nozzle valve at least in part by actuating a needle control valve in a first direction;

closing the nozzle valve while fuel pressure is maintained above the valve opening pressure at least in part by actuating the needle control valve in a second direction;

reopening the nozzle valve for a main injection while fuel pressure is maintained above the valve opening pressure at least in part by actuating the needle control valve in the first direction; and reducing fuel pressure in the fuel injector.

2. The method of claim 1 wherein the raising fuel pressure step includes moving an intensifier piston.

3. The method of claim 2 wherein the moving step includes exposing a hydraulic surface of the intensifier piston to high pressure oil.

4. The method of claim 1 wherein the raising fuel pressure step includes a step of opening an admission valve with an electrical actuator.

5. The method of claim 1 wherein the raising fuel pressure step includes a step of closing a spill valve with an electrical actuator.

6. The method of claim 5 wherein the raising fuel pressure step includes moving a plunger with a cam.

7. The method of claim 1 wherein one of the steps of actuating the needle control valve in a first direction and a second direction includes energizing an electrical actuator.

8. The method of claim 7 wherein the raising fuel pressure step includes a step of opening an admission valve with another electrical actuator.

9. The method of claim 7 wherein the raising fuel pressure step includes a step of closing a spill valve with another electrical actuator.

10. The method of claim 1 wherein the nozzle valve opening and reopening steps include relieving pressure on a closing hydraulic surface of a nozzle valve member.

11. The method of claim 10 wherein the nozzle valve closing step includes a step of increasing pressure on the closing hydraulic surface of the nozzle valve member.

12. The method of claim 1 wherein the reducing step includes closing the nozzle valve while reducing pressure in the fuel injector at least in part by actuating the needle control valve in a second direction.

13. A method of improving accuracy of a pilot injection in a pilot plus main injection sequence, comprising the steps of:

holding a nozzle valve closed while fuel pressure surpasses a valve opening pressure for the nozzle valve;

opening the nozzle valve at least in part by one of energizing and de-energizing an electrical actuator; and closing the nozzle valve at least in part by an other of energizing and de-energizing the electrical actuator.

14. The method of claim 13 including a step of increasing fuel pressure at least in part by energizing another electrical actuator before the opening and closing steps.

15. The method of claim 14 wherein the fuel pressure increasing step includes moving a plunger with one of a cam and an intensifier piston.

* * * * *